United States Patent [19]

Waters

[11] Patent Number: 4,822,305

[45] Date of Patent: Apr. 18, 1989

[54] PROGRAMMABLE KEYING SYSTEM

[75] Inventor: Mark H. Waters, Harrisburg, Pa.

[73] Assignee: AMP Incorporated, Harrisburg, Pa.

[21] Appl. No.: 90,291

[22] Filed: Aug. 31, 1987

[51] Int. Cl.[4] ..... H01R 13/64

[52] U.S. Cl. ..... 439/681; 439/680

[58] Field of Search ..... 439/677, 679, 680, 681, 439/177, 189

[56] References Cited

U.S. PATENT DOCUMENTS

| | | | |
|---|---|---|---|
| 3,426,315 | 2/1969 | Detar | 439/681 |
| 3,474,395 | 10/1969 | Ferdon et al. | 339/186 |
| 3,491,330 | 1/1970 | Barnhart et al. | 439/681 |
| 3,518,620 | 4/1968 | Bushey et al. | 339/184 |
| 3,562,696 | 2/1971 | Barnhart et al. | 339/60 |
| 3,714,617 | 1/1973 | Bright et al. | 439/681 |
| 3,873,172 | 3/1975 | Paullus | 339/17 F |
| 4,159,862 | 7/1979 | Funck et al. | 339/186 |
| 4,277,126 | 7/1981 | Lincoln | 439/681 |
| 4,376,565 | 3/1983 | Bird et al. | 339/186 M |
| 4,448,467 | 5/1984 | Weidler | 339/17 LC |
| 4,449,767 | 5/1984 | Weidler | 339/17 LC |
| 4,568,134 | 2/1986 | DiMondi | 439/680 |
| 4,580,868 | 4/1986 | Verstijnen | 339/186 M |

OTHER PUBLICATIONS

AMP, Incorporated Data Sheet 83-724 Issued 8/83.

"Insertion Error-Proof Board-To-Cable Connector," One Page Document.

*Primary Examiner*—David Pirlot

*Attorney, Agent, or Firm*—David L. Smith

[57] ABSTRACT

A programmable keying system (51) for electrical connectors includes keys (56) which are supported within key-receiving passageways (61) in a connector (10) to cooperate with opposing keys in a complementary connector to ensure that the connector (10) will mate only with a connector with which it is intended to mate. The keys (56) are supported in the passageways (61) in a partially inserted, programmable first position in which they are loosely retained in the passageways (61) by first retention means, but are capable of being rotated to a selected orientation. After being oriented, the keys (56) are pushed fully into the passageways (61) to a locked second position in which they are locked in the passageways (61) in the selected orientation by second retention means. The keying system (51) permits connectors (10) to be shipped to a customer with the keys assembled thereto but with the keys unprogrammed such that they can be programmed in the field at a later time.

13 Claims, 5 Drawing Sheets

PROGRAMMABLE KEYING SYSTEM

BACKGROUND OF THE INVENTION

The present invention relates generally to electrical connectors, and, more particularly, to a programmable keying system for electrical connectors.

Electrical connectors are frequently provided with keying means to permit particular pairs of connectors to properly mate and to prevent the mating of connectors which are not intended to be mated. Keying means are especially useful when a plurality of identical connectors are positioned in close proximity to one another, for example, on a printed circuit board. The incorrect matching of complementary connectors to the connectors on the board can cause serious damage to the circuits improperly connected thereby; and the keying means, by ensuring that each complementary connector will mate with only the correct one of the plurality of connectors on the board, minimizes the risk of improper connection. Keying means are particularly important when the connections are made by untrained personnel as the risk of improper connection is especially great in such circumstances.

Keying systems are known in which a key member is secured in one of a pair of complementary connectors and is adapted to cooperate with an opposing key member secured in the other of the pair of connectors. Each key member is secured in its connector in a selected orientation with respect to its opposing key member so that when the connectors are intended to be mated, extended keying portions on the key members pass by each other during mating to allow the connectors to properly mate. If one of the key members is secured in an incorrect orientation with respect to its opposing key member, however, the extended keying portions on the key members will abut one another during mating to prevent proper mating of the connectors.

Orientation of a key member in a connector is accomplished in several ways. The key member can, for example, be provided with a portion having a polygonal cross-section and be secured within a passageway in the connector having a similar cross-section. The number of sides of the polygonal shape determines the number of possible orientations of the key member.

Many known keying systems for electrical connectors are not fully satisfactory. For example, in connectors containing multiple contacts, many keying systems are capable of preventing incorrectly matched connectors from completely mating with one another, but are not effective in preventing one or more of the individual contacts within the connectors from mating. In many applications, the improper mating of even one pair of contacts in incorrectly matched connectors can close a circuit and cause damage to the circuit.

Also, many known keying systems have a limited number of keying combinations, thus reducing the user's flexibility. In addition, in many known keying systems, the key members are either pre-set in the connector to a particular orientation in the factory necessitating that the customer maintain a larger inventory of differently keyed connectors, or are shipped to the customer disassembled from the connector increasing the number of separate parts which must be shipped and stored.

Many known keying systems are also relatively complex in design and are not readily susceptible to being assembled by automated procedures. This increases manufacturing costs and the cost of the connectors to the ultimate user.

SUMMARY OF THE INVENTION

The present invention relates to a programmable keying system for electrical connectors which comprises a connector having means for defining at least one key-receiving passageway; a key adapted to extend into and be received within each at least one key-receiving passageway, each key including a keying portion movable to any selected one of a plurality of orientations; first retention means for retaining a key in a programmable first position within its respective passageway while permitting the key to be moved to orient the keying portion thereof to a selected one of the plurality of orientations; and second retention means for retaining the key in a locked second position within its respective passageway for locking the keying portion thereof in the selected orientation.

In accordance with the invention, when the key is in the programmable first position, it is partially inserted into the passageway and is relatively loosely retained therein by the first retention means. In the programmable first position the key can be rotated automatically or by an appropriate hand tool to a selected orientation. After being oriented, the key is then fully inserted into the passageway into the locked second position in which the key is locked into the selected orientation by the second retention means.

According to a presently preferred embodiment of the invention, the connector includes two key-receiving passageways adjacent opposite ends thereof which are adapted to receive a pair of identical keys therein. Each key comprises a generally elongated member having a body portion of polygonal cross-section, for example, of hexagonal cross-section; a keying portion extending outwardly from the body portion and adapted to cooperate with the keying portion of an opposed key in a complementary connector; and a retention portion extending inwardly of the body portion and adapted to extend into and be received within a passageway in the connector. The retention portion includes a pair of downwardly extending, flexible leg members having outwardly extending barbs on the ends thereof, and, in addition, has a ribbed section which includes a plurality of raised, longitudinal ribs spaced around the circumference thereof. The passageways each include a reduced diameter portion adjacent the entrance thereof to define an internal annular shoulder therein.

To assemble the key to a connector, the key is first inserted into a passageway with a relatively moderate force. When the retention portion of the key is inserted into a passageway, the flexible legs are compressed inwardly by the reduced diameter portion of the passageway to permit the retention section to be inserted into the passageway. When, however, the legs clear the reduced diameter portion of the passageway, the legs spring outwardly and the barbs at the ends thereof cooperate with the internal shoulder to thereafter resist removal of the key from the passageway. The raised ribs of the ribbed section, which define an outside diameter slightly greater than the diameter of the reduced diameter portion of the passageway, remain outside of the passageway and impinge against the outer surface of the passageway defining means to resist further insertion of the key into the passageway. Thus, the barbs and the ribbed section on the key cooperate with the internal shoulder and the outer surface of the passageway defining means, respectively, to define the first retention means for loosely retaining the key in the programmable first position, partially inserted into the passageway. In this position, the loosely retained key can be rotated to a selected orientation.

After the key is rotated to a selected orientation, the key is then pushed further into the passageway to the locked second position using a more substantial force. The ribbed section of the retention portion is pushed into the passageway and, because the ribbed section has an outside diameter slightly greater than that of the reduced diameter passageway portion, it is received therein with an interference fit to firmly retain the key in the locked second position. A pair of key retention features on the outer surface of the passageway defining means that cooperate with the polygonal body portion of the key to also prevent rotation of the key when the key is in the locked second position. The interference fit between the ribbed section of the key and the sidewall of the passageway, and the cooperation between the polygonal body portion of the key and the key retention features define the second retention means for tightly retaining the key in the locked second position.

According to a further aspect of the invention, the keying system includes detent means for maintaining the keying portion of the key in a desired initial orientation when the key is in the programmable first position. Preferably, the detent means includes forming the larger diameter portion of the passageway with a D-shaped cross-section. The wall of the D-shaped cross-section of the passageway portion cooperates with the flexible legs of the retention portion of the key to prevent accidental rotation of the key when it is in the programmable first position, but does not prevent intentional rotation of the key to finally orient the key. The detent means helps ensure that the keying portion of the key is maintained in a desired initial orientation while in the programmable first position to simplify final orientation and seating of the key by automated equipment.

In general, the keying system of the present invention is highly effective in preventing unmatched complementary connectors from mating with one another and in preventing any contacts in the connectors from mating. The keying system permits keys to be inserted into a connector in the programmable first position by the manufacturer and the connectors to be shipped to the customer as assembled units having no loose parts. The customer can then easily program the keying system in the field and lock the keys in the selected orientation. The keying system of the invention is also usable with both vertical and right angle connectors and with connectors of the plug or receptacle type.

Further advantages and specific details of the invention will become apparent hereinafter in conjunction with the following detailed description of a presently preferred embodiment.

DETAILED DESCRIPTION OF THE PREFERRED EMBODIMENT

Figure 1:
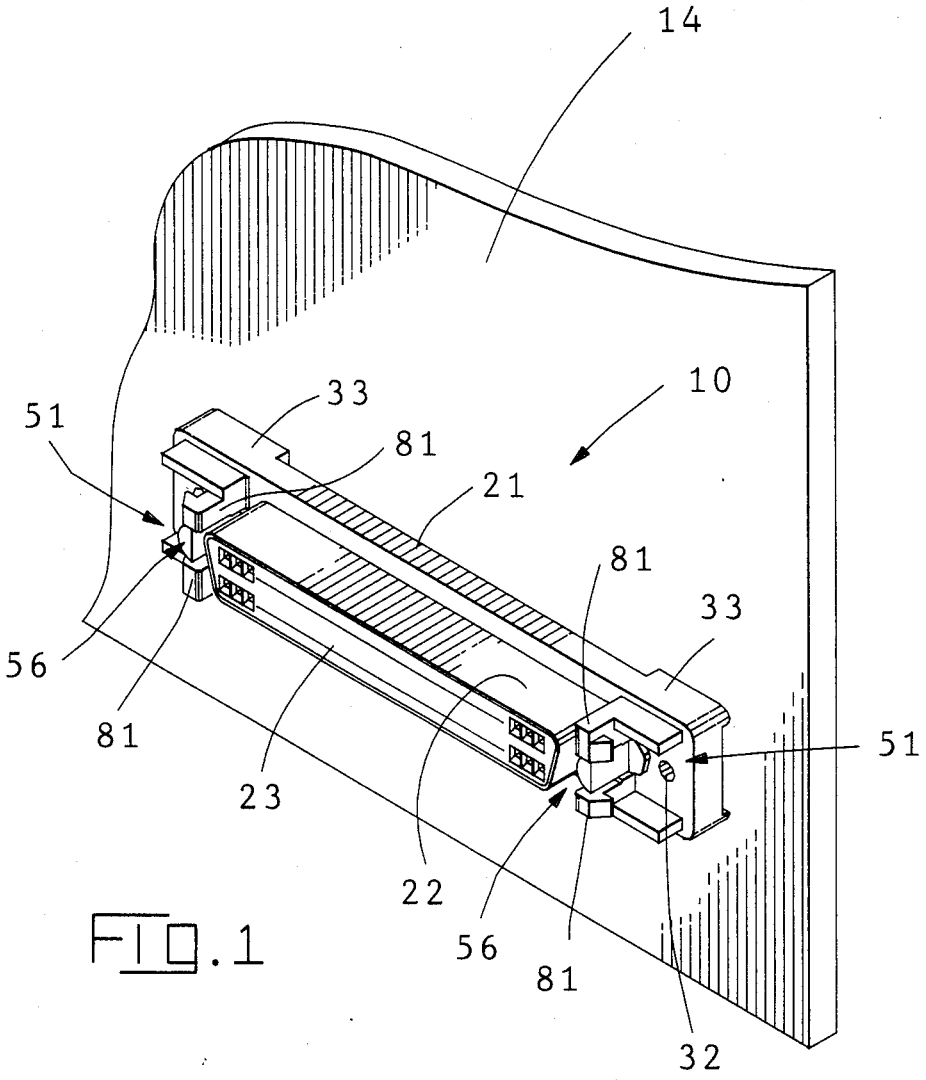
FIG. 1 is a perspective view of a board-mounted, electrical connector incorporating a keying system according to a presently preferred embodiment of the invention.

FIG. 1 is a perspective view of an electrical connector 10 incorporating the keying system of the present invention. Connector 10 comprises a high-density connector, and in the embodiment illustrated, contains two rows of electrical contacts which are adapted to be mated with contacts in a complementary connector (not shown) to complete a plurality of electrical circuits through the connectors as is well-known to those skilled in the art. Connector 10 is designed to be mounted to a printed circuit board or other panel designated by reference numeral 14.

In the embodiment illustrated and described herein, connector 10 comprises a vertically oriented, receptacle connector having a plurality of female contacts 17. This embodiment is intended to be exemplary only. Connector 10 can also comprise a right angle connector and can be of either plug or receptacle type as required for a particular application.

With particular reference to FIGS. 2–6, board-mounted connector 10 comprises a housing 21 formed of die-cast zinc or other suitable material, a drawn metal shroud 22, and a plastic header 23 formed of suitable, thermoplastic, insulating material. Header 23 has a plurality of passageways 24 extending therethrough for receiving female contacts 17 and is supported within shroud 22. Shroud 22 is, in turn, supported within D-shaped polarizing aperture 26 in housing 21 to form the connector 10.

Housing 21 includes a plurality of downwardly extending solder posts 31 to mount the connector to printed circuit board 14. Connector 10 may also be mounted to board 14 by extending mounting screws (not shown) through threaded mounting apertures 32 in the housing. Housing 21 further includes a plurality of mounting feet 33 which are adapted to rest upon the surface of the printed circuit board when the connector is mounted to the board.

Connector 10 is particularly designed for use in applications in which a plurality of identical connectors are mounted in close proximity to one another. For example, printed circuit board 14 can comprise a panel on a computer or the like and contain a plurality of connectors 10 to permit various external equipment to be connected to the computer via complementary connectors coupled to the external equipment by cables or the like. In such applications, it is important to ensure that each connector be mated with the correct complementary connector as mismatching of connector pairs can result in damage to the electrical circuits improperly connected thereby.

To ensure that each connector 10 can mate with only the correct complementary connector, the connectors include keying systems to prevent incorrect connector pairs from being mated. In particular, connector 10 includes a keying system generally designated by reference numeral 51; and as will be explained in greater detail hereinafter, keying system 51 includes a pair of keys 56 which are mounted adjacent opposite ends of connector housing 21 and which include keying portions 68 which can be positioned in any selected one of a plurality of orientations. The complementary connector will similarly include a pair of keys having keying portions which are also positioned in a selected orientation. As is known to those skilled in the art, if the keys of connectors lo and a complementary connector are properly oriented with respect to one another, the keying portions thereof pass by each other as the connectors are mated, permitting the connectors to properly mate. If, however, the keys are not properly oriented with respect to one another, their keying portions will impinge against one another during mating to prevent the connectors from being mated. Keying system 51 thus permits a connector 10 to mate with only the proper complementary connector and not with an incorrect complementary connector.

Keying system 51 of connector 10 is illustrated in greater detail in FIGS. 2, 3 and 6–8. Housing 21 includes a pair of key-receiving passageways 61 adjacent opposite ends thereof. Passageway 61 extends into housing 21 from upper surface 62 thereof and, as best shown in FIGS. 7A and 7B, includes a first, lower passageway portion 61*a* and a second, upper passageway portion 61*b* of slightly smaller diameter. Passageway portion 61*b* is positioned adjacent the entrance to passageway 61, and defines with passageway portion 61*a*, an internal annular shoulder 63 therebetween.

Key-receiving passageways 61 are adapted to receive a pair of keys 56. Key 56 is illustrated in detail in FIG. 8 and comprises a generally elongated member having a body portion 67, a keying portion 68, and a retention portion 69. Body portion 67 is formed to have a cross-section shaped in a regular polygonal shape, preferably, a hexagonal shape, to define the different orientations of key 56. Keying portion 68 is of generally semi-circular cross-section, and extends upwardly from body portion 67, covering approximately one-half of the upper surface of body portion 67.

Figure 8:
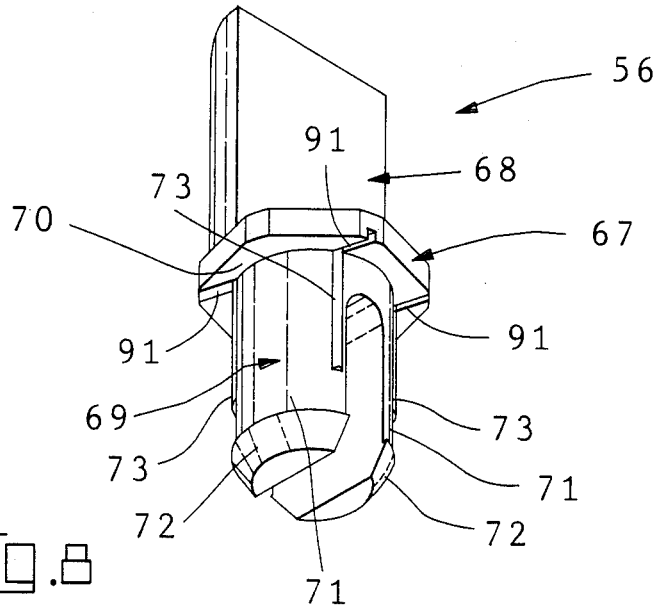
FIG. 8 is a perspective view of the key used in the board-mounted connector of the invention.
Figure 7A:
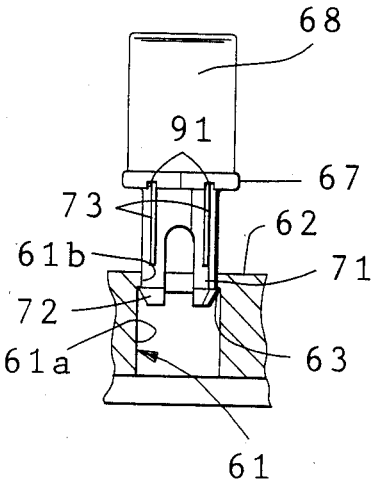
FIGS. 7A and 7B are cross-sectional views looking in the directions of arrows 7A—7A and 7B—7B in FIGS. 6A and 6B, respectively, illustrating the key in programmable and locked positions, respectively.
Figure 7B:
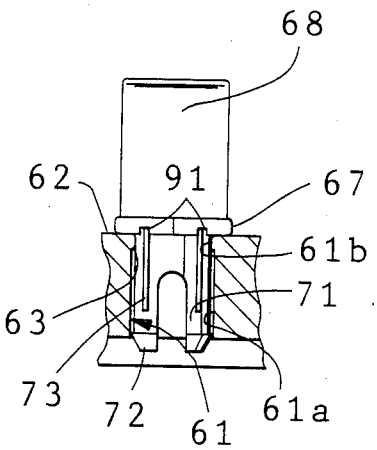

Retention portion 69 extends downwardly from the lower surface 70 of body portion 67 and comprises a pair of downwardly extending, flexible, spring legs 71, each of which has a small projection or barb 72 extending outwardly from the lower end thereof. As shown in FIGS. 7A, 7B and 8, retention portion 69 also includes a plurality of, e.g., four, spaced, outwardly extending longitudinal ribs 73 formed around a ribbed section thereof.

Figure 6A:
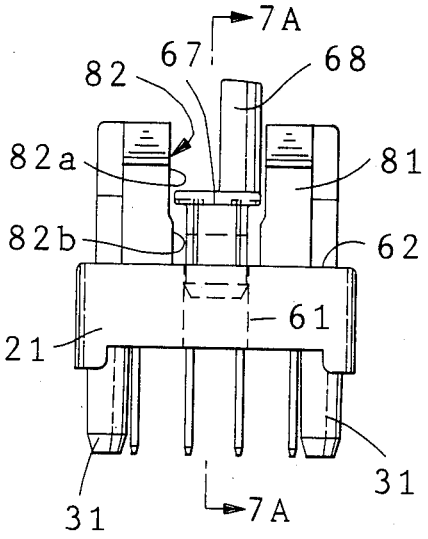
FIGS. 6A and 6B are side views of the connector of FIGS. 1–5 illustrating a key in programmable and locked positions, respectively.
Figure 6B:
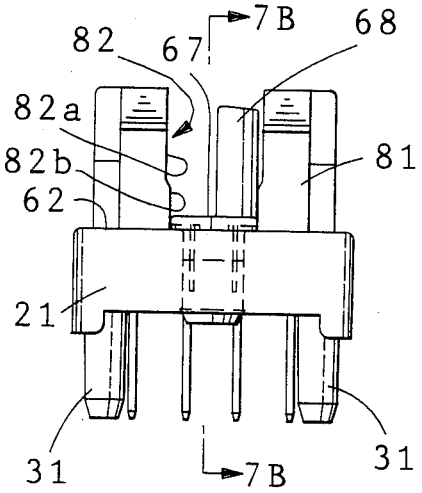

Housing 21 is also provided with a pair of key location features 81 which extend upwardly from upper surface 62 of housing 21 and which are positioned on diametrically opposed sides of each key-receiving passageway 61. Key location features 81 have facing internal surfaces 82 which are parallel to one another and which include a first upper surface portion 82*a* and a second lower surface portion 82*b*. As can be seen in FIGS. 6A and 6B, lower surface portions 82*b* are stepped inwardly from upper surface portions 82*a* to define a reduced spacing between parallel surface portions 82*b* on opposed key location features 81.

Figure 2:
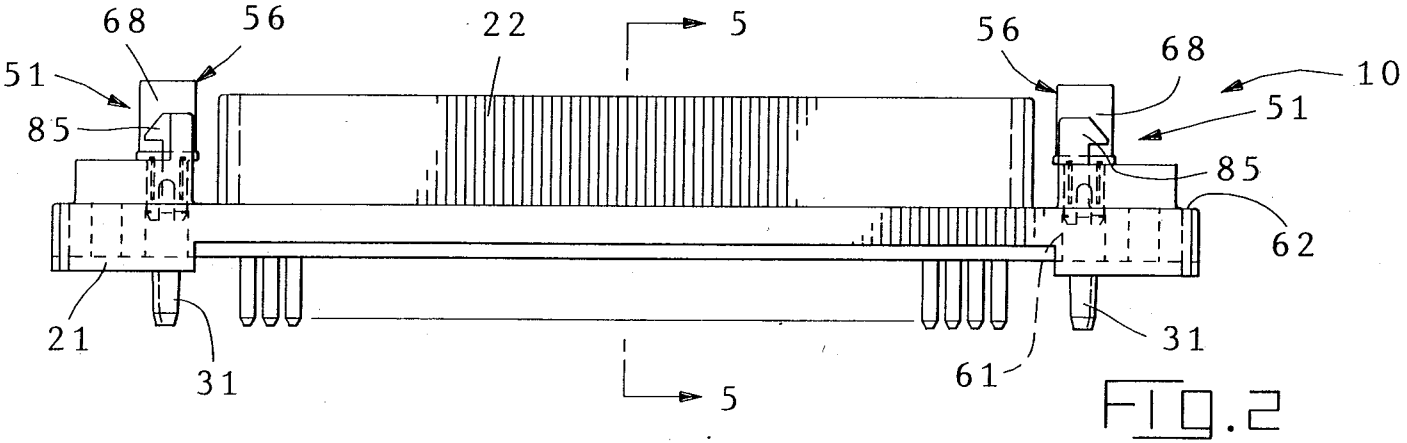
FIG. 2 is a front view of the connector of FIG. 1 with the keys thereon in a programmable first position.
Figure 4:
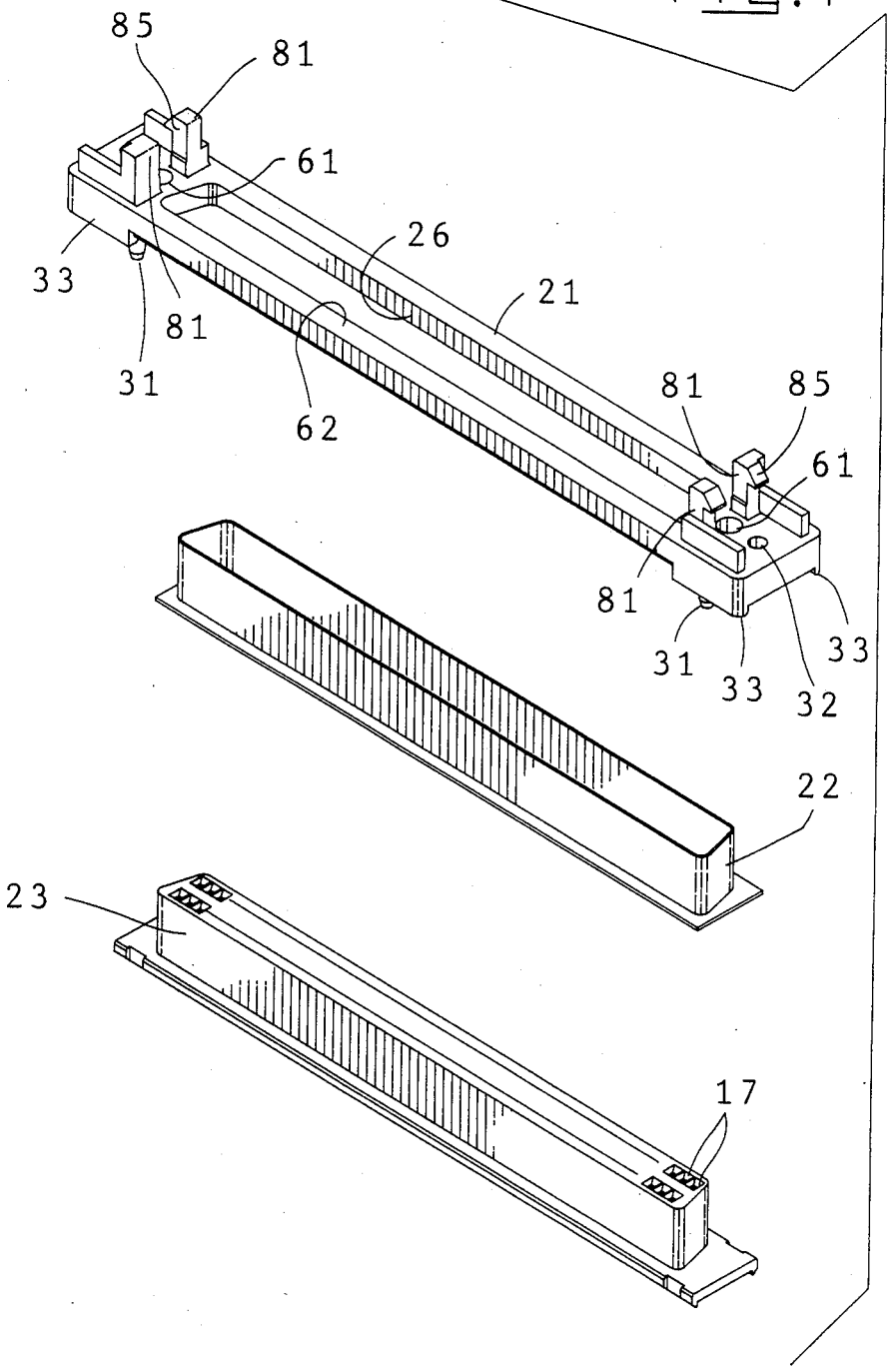
FIG. 4 is an exploded view illustrating the construction of the connector of FIGS. 1–3.
Figure 5:
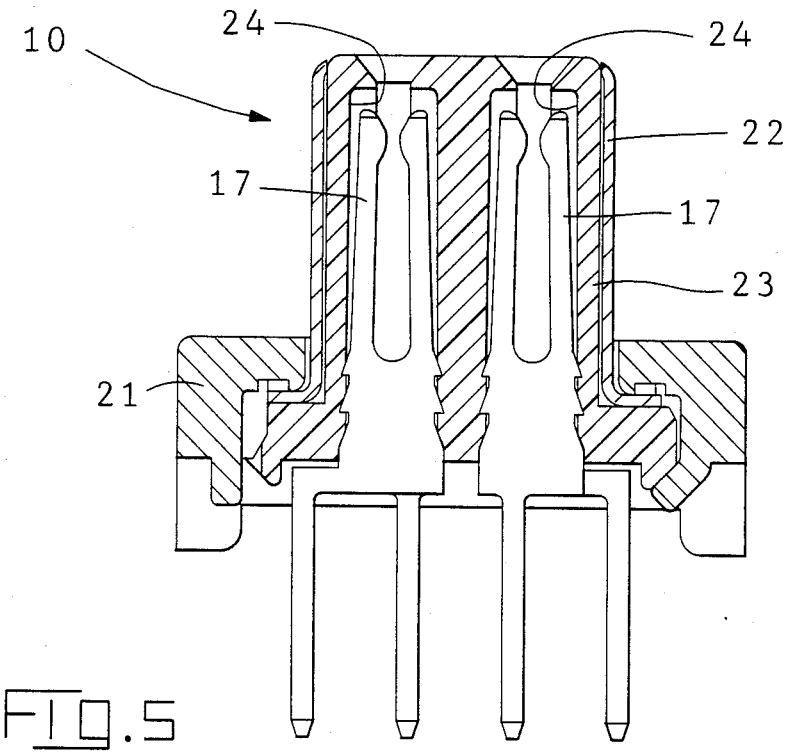
FIG. 5 is a cross-sectional view of the connector of FIGS. 1–4 looking in the direction of arrows 5—5 in FIG. 2.

A key 56 is adapted to be inserted into and retained within each of key-receiving passageways 61 of connector 10. More particularly, keys 56 are adapted to be first inserted into and retained within passageways 61 in a programmable first position in which the keys are partially inserted into and rather loosely retained within passageways 61 such that they are capable of being rotated to orient the keying portions of the keys to any selected one of a plurality of desired orientations; and thereafter seated into a locked second position in which the keys are fully inserted into the passageways to lock the keys in the selected orientation. FIGS. 2, 6A and 7A illustrate keys 56 in the programmable first position within passageways 61, and FIGS. 6B and 7B illustrate a key in the locked second position within the passageways.

To insert a key into a passageway 61 to its programmable first position, the key is pushed axially downwardly into a passageway with a relatively moderate amount of force. As a key is inserted into a passageway, the reduced diameter portion 61*b* of the passageway compresses flexible legs 71 inwardly to permit retention portion 69 to enter into the passageway. Insertion is able to continue until ribs 73 on the ribbed section of retention portion 69 (which defines an outside diameter slightly greater than the diameter of reduced diameter portion 61*b* of passageway 61) impinge upon top surface 62 of housing 21 to oppose further insertion of the key. Also, as insertion progresses, outwardly extending barbs 72 on legs 71 clear the reduced diameter passageway portion 61*b* of passageway 61 and entered larger diameter passageway portion 61*a*. At that time, legs 71 spring outwardly and barbs 72 thereafter cooperate with annular, internal shoulder 63 in passaqeway 61 to oppose withdrawal of the key from the passageway. Thus, barbs 72 and ribs 73 on key 56 cooperate with internal shoulder 63 of passageway 61 and outer surface 62 of housing 21, respectively, to define a first retention means for loosely retaining key 56 in the programmable first position, partially inserted into passageway 61. While in the programming position, however, key 56 can be rotated by a hand tool or by suitable automated equipment to position the keying portion 68 of key 56 in a selected orientation.

After key 56 has been rotated to orient the keying portion 68 thereof in a desired orientation, the key is then pushed fully into passageway 61 with a more substantial force to lock the key in the passageway in the locked second position in the desired orientation. The more substantial force overcomes the resistance of the ribs against the outer surface 62 of the housing allowing the ribs to enter into passageway 61 as shown in FIG. 7B. The ribbed section of the key is received within reduced diameter portion 61*b* of passageway 61 with an interference fit to firmly retain the key within the passageway and to thereafter prevent removal of the key from the passageway or rotation of the key within the passageway.

As shown in FIG. 6A, when key 56 is in the programmable first position, body portion 67 thereof is aligned with upper, parallel surface portions 82*a* of key location features 81. Surfaces 82*a* are spaced sufficiently apart to permit the key to be freely rotated to the selected orientation. In this position also, keying portion 68 extends above the top of the key location features to permit the keying portion to be easily held by a hand tool or other means to rotate the key. When the key is fully inserted into passageway 61, however, as shown in FIG. 6B, body portion 67 is aligned with parallel surface portions 82*b* of features 18. Surfaces 82*b* are positioned more closely together and receive body portion 67 therebetween with a rather close fit to prevent rotation of body portion 67 and of the key in general when the key is in the locked second position. Thus, when key 56 is in the locked second position, the interference fit between the ribbed section of the key and the sidewall of passageway portion 61*b*, and the cooperation between the polygonal body portion 67 of key 56 and surfaces 82*b* of features 81 define second retention means for retaining the key in the locked second position in the passageway.

With the keying system of the present invention, the manufacturer can assemble the keys to the connector in the programmable first position, and ship the assembled connectors to the customer. The customer can then quickly program the keys in the field by rotating them to a selected orientation and then locking them into their locked second position for use. The invention thus avoids the need for the manufacturer to ship disassembled parts which can be lost or to program the keying system in the factory or prekeyed connectors necessitating a larger inventory.

As shown in several of the Figures, key location features 81 are formed to include small latching portions 85. Latching portions 85 are adapted to receive spring latches on a complementary connector (not shown) to lock the connectors together after mating.

As shown in FIGS. 7A, 7B and 8, the lower surface 70 of body portion 67 of each key 56 is provided with a plurality of narrow channels 91. Channels 91 comprise burr pockets to carry away any burr removed from ribs 73 when the ribs are pres--fit into passageway 61 to ensure that the key is fully inserted into passageway 61 with lower surface 70 of body portion 67 in contact with upper surface 62 of housing 21.

Figure 3:
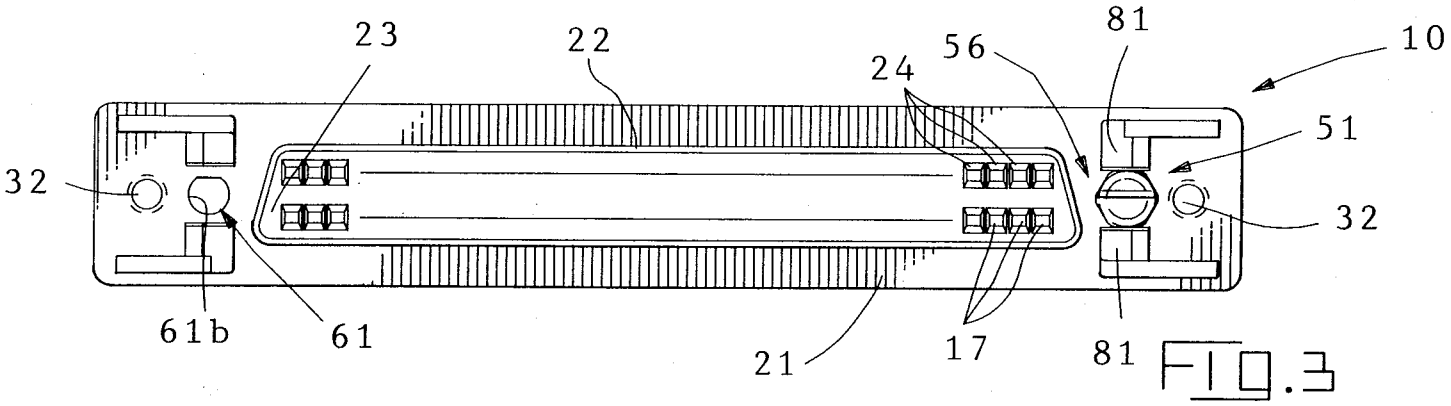
FIG. 3 is a top view of the connector of FIGS. 1 and 2 with one of the keys omitted to illustrate a feature of the invention.

FIG. 3 illustrates a further feature of the invention. In FIG. 3, the key has been removed from the left passageway 61 to better illustrate the passageway. As shown, larger diameter portion of passageway 61 is o formed to have a generally D-shaped cross-section. This D-shaped configuration (which, for illustrative purposes, is somewhat exaggerated in the Figure) cooperates with resilient legs 71 of the key retention portion 69 of the key to slightly resist rotation of the key while the key is in the programmable first position. The chordal section of the D-shaped passageway corresponds to the chordal space between the cross-section of legs 71. Thus keys 56 may be inserted to the programmable first position and maintained by the detent feature in either of two predetermined orientations.

This detent feature permits the keys 56 to be inserted into and to be retained in the passageway in a predetermined initial orientation while the key is in the programmable first position to facilitate orienting and final insertion of the key into the passageway by automated equipment. Without the D-shaped configuration of the passageway, the key could rotate freely while in the programmable first position, making it more difficult to use automated equipment for final orienting and seating. The D-shape of passageway portion 61 is sufficient to prevent accidental rotation of the key within the passageway, but will not prevent intentional rotation by a hand tool or the like. As key 56 is rotated from an initial orientation to a final orientation, one of resilient legs 71 will flex radially inward and ride over the chordal section of the D-shaped passageway.

While what has been described constitutes a presently preferred embodiment of the invention, it should be recognized that the invention could take numerous other forms. For example, if desired, the burr pockets could be formed in upper surface 62 of the connector housing rather than in the bottom surface 70 of the body portion of the key. Alternatively, the outwardly projecting, ribbed portions on key 73 could be replaced by inwardly extending slots on the inside surface of passageway 61; and the key could be provided with an enlarged diameter portion to provide the interference fit with the wall of the passageway. Because the invention can take numerous other forms, it should be understood that the invention should be limited only insofar as is required by the scope of the following claims.

I claim:

1. A programmable keying system for electrical connectors, comprising:

a connector having at least one key-receiving passageway therein;

a key adapted to extend into and be received within each at least one key-receiving passageway, each key including a keying portion rotatable to any one of a plurality of orientations;

first retention means for relatively loosely retaining the key in a programmable first position partially inserted into its respective passageway while permitting said key to be rotated to orient said keying portion to a selected one of said plurality of orientations;

second retention means for retaining said key in a locked second position fully inserted into its respective passageway for locking said keying portion in said selected orientation; and third means for resisting unintentional insertion of said key into said passageway from said programmable first position to said locked second position while permitting intentional insertion of said key to said locked second position for locking said keying portion in said selected orientation.

2. The keying system of claim 1 wherein said at least one key-receiving passageway comprises two key-receiving passageways adjacent opposite ends of said connector for receiving keys therein.

3. The keying system of claim 1 wherein said third means comprises a plurality of outwardly extending ribs on said key which are adapted to be received within said passageway with an interference fit.

4. The keying system of claim 1 and further including fourth means for resisting unintentional rotation of said key when said key is in said programmable first position while permitting intentional rotation of said key to rotate said keying portion to said selected orientation.

5. The keying system of claim 4 wherein said key includes a retention portion adapted to extend into and be received within its respective passageway, said retention portion including a flexible leg portion, and wherein at least a portion of said passageway includes a generally D-shaped cross-section, said flexible leg portion of said retention portion cooperating with said passageway portion of generally D-shaped cross-section for defining said fourth means for slightly resisting rotation of said key while the key is in said programmable first position.

6. A programmable keying system for electrical connectors, comprising:

a connector having at least one key-receiving passageway therein;

a key adapted to extend into and be received within each at least one key-receiving passageway, each key including a body portion having a polygonal cross-section, a keying portion extending upwardly from said body portion and rotatable to any one of a plurality of orientations, and a retention portion extending downwardly from said body portion and adapted to extend into and be received within its respective passageway;

first retention means for retaining each key in a programmable first position with the retention portion thereof partially inserted into its respective passageway while permitting the key to be rotated to orient the keying portion thereof to any selected one of said plurality of orientations; and second retention means for retaining each key in a locked position with the retention portion thereof fully inserted into its respective passageway for locking said keying portion in said selected orientation, said first retention means including an internal shoulder in each said at least one passageway and a pair of flexible, downwardly extending legs having a barb extending outwardly from the lower ends thereof on said retention portion of each key, said flexible legs permitting insertion of said retention portion of a key into its respective passageway and said barbs cooperating with said internal shoulder to thereafter resist removal of said retention portion from its respective passageway when a key is in said programmable first position in its respective passageway.

7. The keying system of claim 6 and further including detent means for preventing unintentional rotation of said key when said key is in said programmable first position in said passageway.

8. The keying system of claim 7 wherein said detent means comprises providing a portion of said passageway with a generally D-shaped cross-section for cooperating with said retention portion of said key for preventing unintentional rotation of said key when said key is in said programmable first position.

9. The keying system of claim 6 wherein said at least one key-receiving passageway includes an upper passageway portion of reduced diameter and wherein said retention portion further includes a ribbed section having a plurality of outwardly extending ribs defining an outside diameter greater than the diameter of the reduced diameter passageway portion for resisting insertion of said retention portion into said passageway beyond said programmable first position.

10. The keying system of claim 9 wherein said plurality of outwardly extending ribs is adapted to be received within said passageway with an interference fit, said second retention means including said interference fit to firmly retain said retention portion of said key in said passageway when said key is in said locked second position.

11. The keying system of claim 10 and further including a plurality of channels for carrying away burr removed from said ribs as a result of said ribs being received in said passageway with an interference fit.

12. A programmable keying system for electrical connectors, comprising:

a connector having two, spaced key-receiving passageways therein;

a key adapted to extend into and be received within each key-receiving passageway, each key including a body portion having a polygonal cross-section, a keying portion extending upwardly from said body portion, and a retention portion extending downwardly from said body portion, each said key being rotatable to orient said keying portion in any selected one of a plurality of orientations;

first retention means for relatively loosely retaining said retention portion of each key in a programmable first position partially inserted into its respective passageway while permitting said key to be rotated to orient said keying portion to a selected one of said plurality of orientations;

second retention means for tightly retaining said retention portion of each key in a locked second position fully inserted into its respective passageway for locking said keying portion in said selected orientation; and detent means for preventing unintentional rotation of said keys when each of said keys is in said programmable first position while permitting intentional rotation of said keys to rotate said keying portion to said selected orientation.

13. A programmable keying system for electrical connectors, comprising:

a connector having means for defining at least one key-receiving passageway therein;

a key adapted to extend into and be received within each said at least one key-receiving passageway, each key including a body portion having a polygonal cross-section, a keying portion extending upwardly from said body portion and rotatable to any one of a plurality of orientations, and a retention portion extending downwardly from said body portion and adapted to extend into and be received within its respective passageway;

first retention means for retaining each key in a programmable first position with the retention portion thereof partially inserted into its respective passageway while permitting the key to be rotated to orient the keying portion thereof to any selected one of said plurality of orientations;

second retention means for retaining each key in a locked second position with the retention portion thereof fully inserted into its respective passageway for locking said keying portion in said selected orientation; and means for defining a pair of diametrically opposed, parallel surfaces, said surfaces having first upper surface portions which are sufficiently spaced from one another to provide a clearance for said body portion of said key, and second, more closely spaced, lower surface portions, said body portion of said key being aligned with said first surface portions when said key is in said programmable first position permitting said key to be rotated, and being aligned with said second surface portions when said key is in said locked second position for preventing rotation of said key.

* * * * *